US005961813A

United States Patent [19]

Gestermann et al.

[11] Patent Number: 5,961,813

[45] Date of Patent: Oct. 5, 1999

[54] PROCESS FOR DIRECT ELECTROCHEMICAL GASEOUS PHASE PHOSGENE SYNTHESIS

[75] Inventors: Fritz Gestermann, Leverkusen; Jürgen Dobbers, Krefeld; Hans-Nicolaus Rindfleisch, Brunsbüttel, all of Germany

[73] Assignee: Bayer Aktiengesellschaft, Leverkusen, Germany

[21] Appl. No.: 09/077,062

[22] PCT Filed: Nov. 12, 1996

[86] PCT No.: PCT/EP96/04934

§ 371 Date: May 18, 1998

§ 102(e) Date: May 18, 1998

[87] PCT Pub. No.: WO97/19205

PCT Pub. Date: May 29, 1997

[30] Foreign Application Priority Data

Nov. 23, 1995 [DE] Germany ..... 195 43 678

[51] Int. Cl.[6] ..... C25B 1/24

[52] U.S. Cl. ..... 205/556

[58] Field of Search ..... 205/555, 556

[56] References Cited

U.S. PATENT DOCUMENTS 5,411,641 5/1995 Trainham, III et al. ..... 204/59 R

OTHER PUBLICATIONS

Chemical Abstract, vol. 90, 1979, Ref. 159157m. No Month Available.

JP 4–6290 A. In. Patents Abstracts of Japan, C–928, Apr. 13,1992, vol. 16, No. 148.

*Primary Examiner*—Kathryn Gorgos
*Assistant Examiner*—Edna Wong
*Attorney, Agent, or Firm*—Joseph C. Gil; Lyndanne M. Whalen

[57] ABSTRACT

An electrochemical cell (1 ) having a proton-conducting membrane (4) is used in the process for the direct electrochemical gas phase synthesis of phosgene. Dry HCl gas and dry CO gas are supplied as the educts to the anode (2) of the electrochemical cell (1). The chlorine radicals formed on anodic oxidation of the HCl gas then react directly with the CO gas to yield phosgene, while the simultaneously formed protons migrate through the membrane (4) to the cathode (3) and are there reduced to hydrogen or, in the presence of oxygen, to water.

20 Claims, 2 Drawing Sheets

PROCESS FOR DIRECT ELECTROCHEMICAL GASEOUS PHASE PHOSGENE SYNTHESIS

This is a national stage application of PCT/EP96/04934 filed Nov. 12, 1996.

This invention relates to a process for the electrochemical conversion of hydrogen chloride to phosgene. According to the hitherto conventional processes, phosgene has been produced catalytically from free chlorine. The chlorine is either produced generically from NaCl electrolysis, wherein the HCl gas originating, for example, from isocyanate production, is further processed in the form of hydrochloric acid or is recovered as recycled chlorine from the electrolysis of aqueous hydrochloric acid.

U.S. Pat. No. 5,411,641 describes an electrochemical process for the production of chlorine in which dry direct oxidation of HCl to chlorine and protons proceeds in the electrochemical cell. Even with an aqueous electrolyte on the cathode side in conjunction with hydrogen production, the process operates at distinctly more favourable operating voltages than the conventional electrolysis of aqueous hydrochloric acid.

The object of the invention is directly to produce phosgene by electrochemical methods starting from gaseous hydrogen chloride.

This object is achieved according to the invention by HCl gas and dry CO gas being supplied as the educts to the anode of an electrochemical cell equipped with a proton-conducting membrane and the chlorine radicals formed from the anodic oxidation of HCl gas directly reacting with the CO gas to yield phosgene, while the simultaneously formed protons migrate through the membrane to the cathode and in the event of operation with aqueous HCl, are there reduced to hydrogen or, in the presence of oxygen, to water.

In this process, the chlorine radicals are typically anodically oxidised at the anode with CO gas to yield phosgene in accordance with the following reaction equations $$HCl + CO \xrightarrow{\text{electr. energy}} COCl^{\ominus} + e^{-} + H^{+}$$

$$COCl^{\ominus} + HCl \xrightarrow{\text{electr. energy}} COCl_2 + e^{-} + H^{+}$$

The reaction is preferably performed in such a manner that, in addition to the electrochemical anodic oxidation, an exothermic catalytic reaction of molecular chlorine with CO gas to yield phosgene proceeds in the support material containing carbon of the activated diffusion anode in accordance with the reaction equation $$CO + Cl_2 \rightarrow COCl_2.$$

Due to the phosgene radicals arising in this reaction, the anodic overvoltage may be reduced by 0.2 V–0.6 V.

The process is advantageously performed in such a manner that, in order to reduce the operating voltage of the electrochemical cell, the oxygen is reduced on the cathode (3) and is consumed by reaction with the protons diffusing through the membrane to yield water.

Alternatively, the process may, however, be performed in such a manner that the cathode (3) is operated in aqueous hydrochloric acid, wherein hydrogen is produced as the secondary product.

In order to establish its proton conductivity, the membrane is additionally moistened with moist oxygen, which is supplied to the cathode with the educt gas.

According to a preferred embodiment, the electrochemical reactions at the cathode and anode are performed at a pressure of 2 bar to 6 bar.

A further development of the process according to the invention consists in cooling and liquefying the stream of phosgene drawn off from the anode side under the operating pressure in a recuperator and depressurising and vaporising the liquefied phosgene on the secondary side of the recuperator, wherein the refrigeration capacity required for liquefaction is created and any HCl and CO educt gas present in the phosgene liquefied on the primary side is simultaneously removed. Any such educt gas may then be returned to the electrochemical cell.

The electrochemical cell is here advantageously operated in a closed system, which also includes the recuperator, at a pressure of 2 bar to 10 bar, preferably of 2 bar to 6 bar, in such a manner that the pressure differential between the closed system and the electrochemical cell is virtually zero, such that even when relatively high pressures are used the electrochemical cell may be operated almost without pressure.

In comparison with conventional phosgene production processes, the following advantages are achieved:

- With the addition of the appropriate quantity of CO, the dry hydrogen chloride may be directly electrochemically reacted in the gas phase to yield phosgene.
- If the composition of the educt gas mixture is appropriately adjusted, the free chlorine content in the product gas may be reduced to negligibly low values. However, even in the event that small quantities of HCl and CO are still present, the product gas may be used directly for certain chemical processes, for example isocyanate or polycarbonate production, as in this case these residual quantities of gas pass passively through the process and then combine with the stream of HCl liberated during formation of the isocyanate or polycarbonate, which HCl stream may be reintroduced as an educt gas for electrochemical phosgene production. Any unreacted residues of phosgene do not disrupt the electrochemical reaction. At the most, if present in appreciable concentrations, they act as a diffusion ballast at the gas diffusion anode.
- Due to the relatively simple design of the electrolysis apparatus in comparison with the large number of successive processing stages necessary in conventional phosgene production, plant and equipment costs may be substantially reduced (lower investment costs).

In conventional phosgene production, in which, even where aqueous hydrochloric acid electrolysis is used, energy requirements amount to approximately 180 kWh/100 kg of chlorine, the many processing stages entail much higher energy consumption due to the large number of pumps or compressors required and due to the refrigerant required (extrinsic cooling). The process according to the invention has considerably more favourable operating costs in this respect.

From a purely thermodynamic viewpoint, the electrochemical reaction of HCl gas with oxygen would be exothermic at voltages of as low as approximately 0.18 V. In practice, however, the oxygen overvoltage of 300–400 mV and the electrical resistance of the ion exchange membrane degrade the energy balance.

Due to its exothermic nature, the direct involvement of CO and COCl radicals in the electrochemical process has a positive influence upon electrolysis potentials. A reduction of approximately 200–600 mV may be achieved.

BRIEF DESCRIPTION OF THE DRAWINGS

The drawings and practical examples below illustrate the invention in greater detail. The drawings show.

Figure 1:
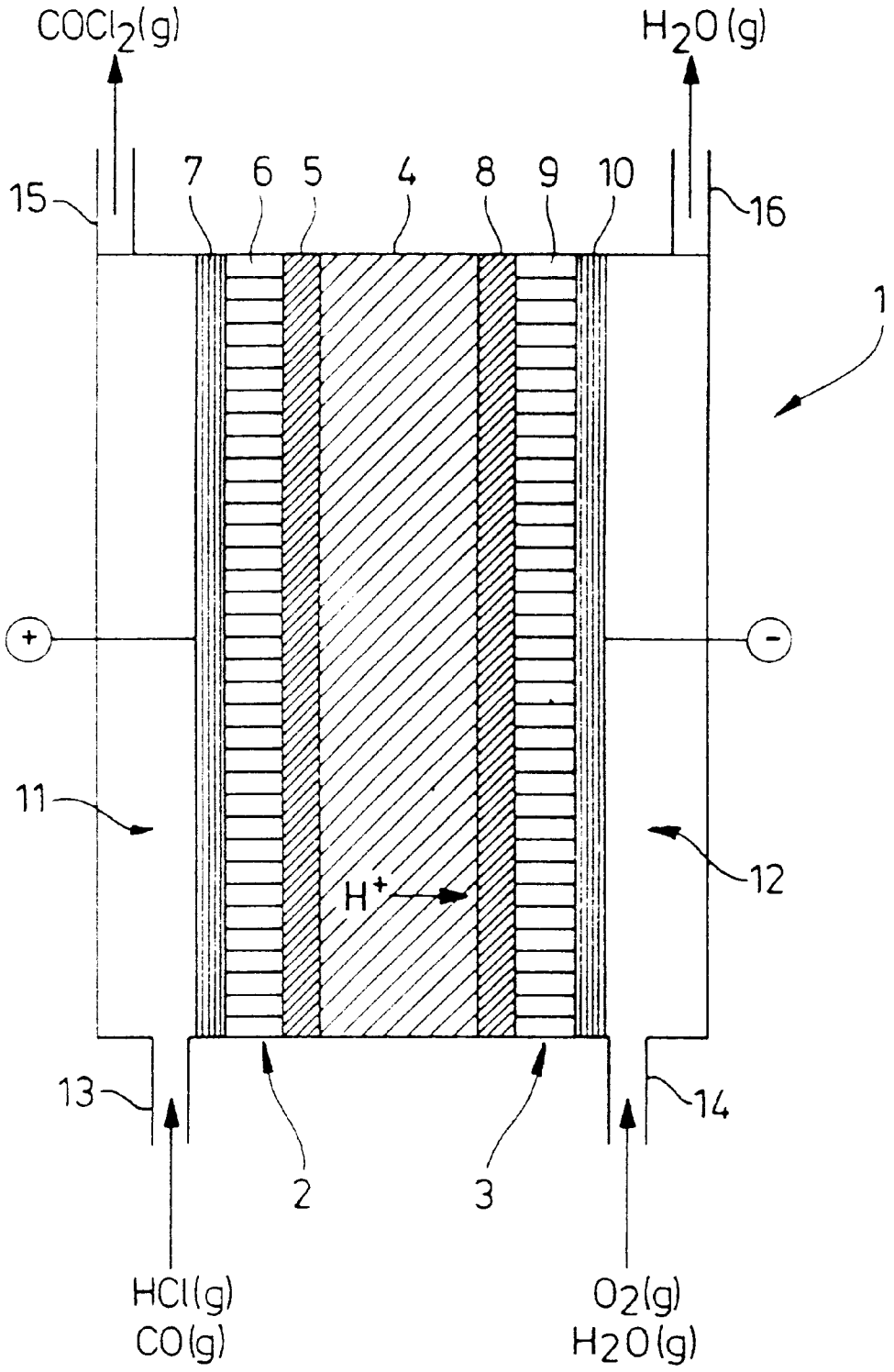
FIG. 1 Schematic diagram of the structure of an electrolysis cell for the direct electrochemical production of phosgene and FIG. 2 the basic structure of a phosgene electrolysis unit in a pressure-resistant system using a phosgene recuperator.

The general reaction mechanisms of the electrochemical processes which typically proceed at the cathode and anode will first be described.

1. Cathode process

At the cathode, a catalytic oxygen reduction (catalyst for example Pt, Ir or Pd) of the introduced oxygen proceeds at the interface with the proton-conducting membrane located between the two electrodes. In a similar manner as in a PEM (polymer electrolyte membrane) fuel cell, the oxygen or the introduced gas mixture containing oxygen (feed gas) is moistened with water up to its saturation point. The reaction proceeds in accordance with the equation:

$$\tfrac{1}{2}O_2+2e^-+2H^+ \Rightarrow H_2O(\text{gaseous}) \quad (1)$$

The water balance of the proton-conducting membrane is controlled by the premoistening of the feed gas, while taking account of the formation of the water of reaction according to equation (1).

2. Electrolyte

In a similar manner as in a PEM fuel cell, the single layer proton-conducting membrane made from fluoropolymer with protonated sulphonic acid groups in the ion transport channels, acts as a solid electrolyte between the cathode and anode. As described above, proton conductivity is improved by moistening the cathode side.

3. Anode process

The basic process involves the direct oxidation of dry HCl gas to yield chlorine and protons, which are introduced into the membrane acting as the electrolyte, in accordance with the following reaction $$HCl \xRightarrow{\text{el. energy}} Cl^{\ominus} + e^- + H^+ \quad (2)$$

Oxidation proceeds catalytically (catalyst Pt, Ir, Rh or Pd) at the interface between the anode and the proton-conducting membrane. Direct oxidation of HCl yields, without the presence of further reactants, dry chlorine, which immediately further reacts with the simultaneously supplied dry CO gas. Two reaction paths are possible here, both of which proceed exothermically:

3.1 Direct influence on direct oxidation of HCl

CO reacts with the chlorine radical produced at the anode to yield the COCl radical, which in turn reacts with a further chlorine radical to yield $COCl_2$ and diffuses away from the electrocatalysis zone. In this case, the reaction mechanism at the anode is as follows:

$$HCl + CO \xRightarrow{\text{el. energy}} COCl^{\ominus} + e^- + H^+ \quad (3)$$

$$COCl^{\ominus} + HCl \xRightarrow{\text{el. energy}} COCl_2 + e^- + H^+ \quad (4)$$

Hydrogen chloride oxidation is thus directly or indirectly influenced by CO in both stages of the reaction. The heat liberated by the reaction stages is at least partially converted into a reduction in the activation energy of the direct electrochemical oxidation of HCl, so resulting in a reduction in cell voltage.

3.2 Indirect process

Any chlorine radicals which have not reacted with CO or COCl radicals recombine to yield $Cl_2$. The conventional support material for electrochemically active catalysts incorporated into the electrodes is carbon in the form of Vulcan or acetylene black, wherein the product gases $Cl_2$ and $COCl_2$ released from the electrolysis pass through this microporous support layer. This layer here operates as an activated carbon surface which, while it does not catalyse the electrochemical reaction, at conventional cell temperatures of approximately 80° C., it does catalyse the exothermic reaction, $$CO+Cl_2 \Rightarrow COCl_2 \quad (5)$$

A dry anodic product gas is then obtained having the following composition:

$COCl_2$+unreacted HCl gas+unreacted CO+possibly traces of $Cl_2$.

An electrochemical cell for the performance of the above-stated reactions is described below.

The electrochemical cell 1 according to FIG. 1 substantially consists of the gas diffusion anode 2, the gas diffusion cathode 3 and the proton-conducting membrane 4 arranged between the electrodes which acts as the electrolyte. Such membrane electrolytes are commercially available for electrochemical fuel cells. The anode 2 consists of a porous, catalytically activated, activated carbon matrix 5, the inner side of which is joined to the membrane 3 and the outer side of which is connected with a conductive gas distributor 6, which is in contact with an anodic current distributor 7. The cathode 3, which is of a similar structure, consists of the catalytic activated carbon matrix 8, the conductive gas distributor 9 and the current distributor 10. Platinum, iridium, rhodium and palladium are primarily considered as the catalytic material. Such gas diffusion anodes and cathodes are also commercially available (for example electrodes of the ELAT type from GDE Gasdiffusionselektroden GmbH, Frankfurt am Main).

The anode 2 is arranged in an anode gas compartment 11, the cathode 3 in a cathode gas compartment 12. With the exception of the inlet and outlet ports, both gas compartments 11 and 12 are closed. A dry educt gas mixture of HCl and CO is introduced into the anode gas compartment 11 via the feed port 13 and a gaseous educt gas mixture of oxygen and saturated water vapour is introduced into the cathode gas compartment 12 via the feed port 14. The water vapour produced during the cathodic reduction, together with the steam introduced by the educt gas, ensure sufficient moistening of the membrane 4, such that it cannot dry out. Excess water vapour, together with unreacted oxygen, may be discharged via the outlet port 16.

Phosgene ($COCl_2$) is produced at the gas diffusion anode 2 in accordance with the reaction mechanism described above, which phosgene is discharged via the product port 15. The electrochemical reactions at the anode and cathode are performed at temperatures of 40° C. to 80° C., at a cell voltage of 0.8 to 1.2 V and cell current densities of approximately 3 kA/$m^2$. The process may, however, also be performed with higher current densities. The educts are introduced in the stoichiometric ratio in accordance with the above reaction equations. CO gas may, however, also be supplied to the anode in hyperstoichiometric quantities in order to suppress the formation of free chlorine.

Figure 2:
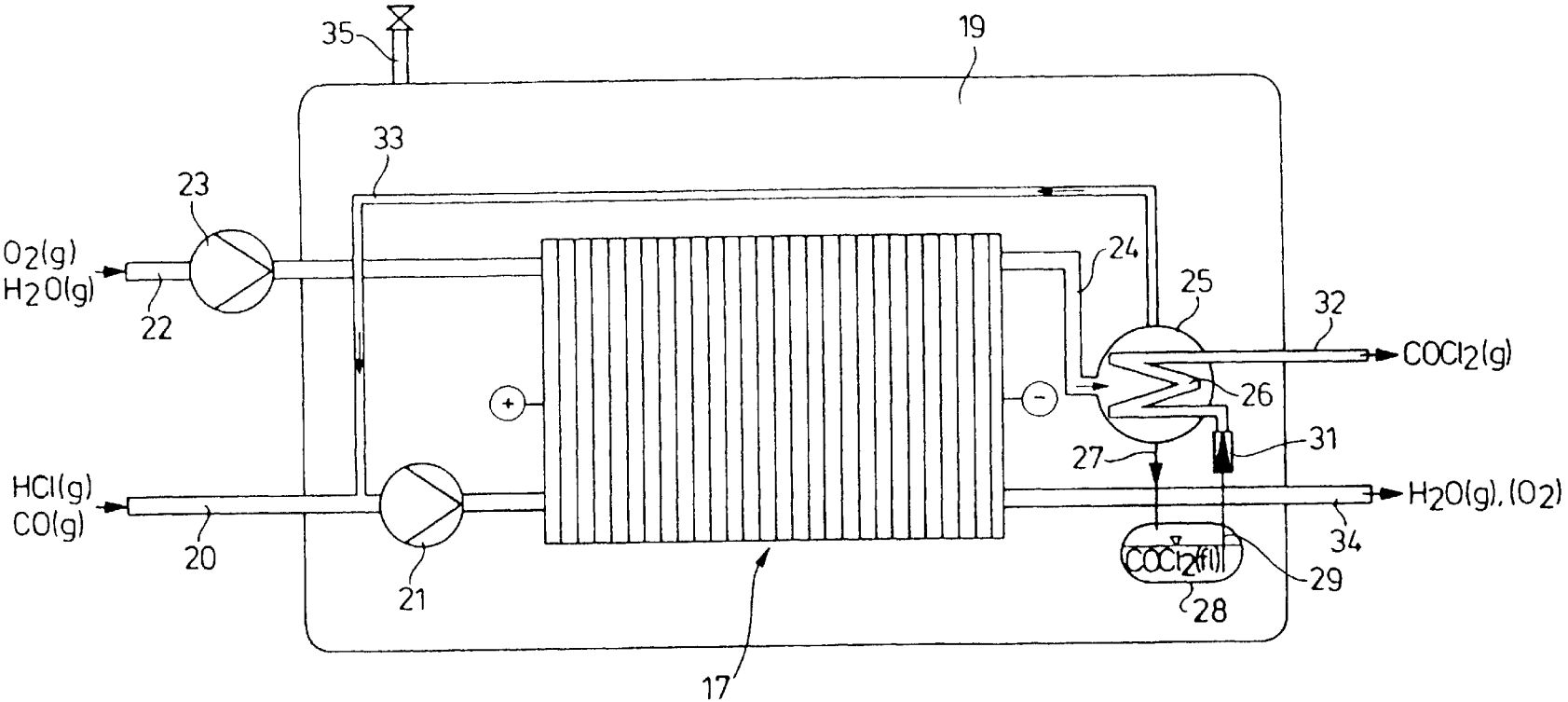

In the more developed electrolyser shown in FIG. 2, a plurality of electrochemical cells 1 of a similar structure to FIG. 1 are housed in a casing 18 (not shown) as a bipolar cell stack 17 connected in series or in parallel.

The enclosed pressure compartment 19 constitutes a gas-tight, pressure-resistant, closed system designed for maximum pressures of 10 bar, wherein the pressure differential relative to the actual process pressure is offset to virtually zero. The dry educt gas mixture HCl+CO is supplied to the anodes via the educt gas line 20 and the compressor 21. The cathode is supplied with $O_2$+$H_2O$ as the educt gas via the educt gas line 22 and the compressor 23. The educt gas mixtures may be compressed to up to approximately 6 bar by means of the compressors 21 and 23.

The product line 24 arranged at the outlet of the cell stack 17 is connected with a phosgene recuperator 25, in which the phosgene produced in the cell stack 17 is liquefied by cooling condensation on the heat exchanger tube bundle 26. The liquid phosgene flows through the line 27 into a storage vessel 28. The refrigeration capacity required for liquefaction is created by depressurising liquid phosgene from the storage vessel 28 in the recuperator 25. To this end, the heat exchanger tube 26 is connected to the storage vessel 28 via a rising line 29. Immediately before the recuperator 25, the liquid phosgene flows through an expansion valve 31 in the rising line 29. The liquid phosgene vaporises as it is depressurised. In this case, the phosgene thus acts as a refrigerant in order to condense the product gas, which substantially consists of phosgene. Any unreacted HCl and CO educt gas present in the product gas is removed by this condensation and revaporisation. The resultant purified gaseous phosgene is drawn off via the discharge line 32. Depressurisation proceeds from the educt gas overpressure prevailing in the cell stack 17 down to approximately standard pressure or down to the low initial pressure required for the subsequent reactions, such that pressure-resistant fittings are not required for the discharge line 32 passing out of the electrolyser. The residual gases consisting of HCl and CO concentrated in the top part of the recuperator 25 are recycled to the anode inlet via the return line 33. The cathode-side outlet of the cell stack 17 is connected with a waste gas line 34 to discharge excess oxygen and water vapour. The pressure compartment 19 is pressurised via the pressurisation port 35 with an inert gas, for example nitrogen, and maintained at approximately the same pressure corresponding to the initial educt gas pressure produced with the compressors 21 and 23. The electrochemical cells would otherwise have to be of a pressure-resistant design. This enclosure simultaneously provides the reaction equipment with an inert atmosphere which may be monitored for educt or product gas leaks using simple means.

We claim:

1. A process for electrochemically converting hydrogen chloride to phosgene comprising a) supplying dry HCl gas and dry CO gas as educts to an activated diffusion anode of an electrochemical cell which is equipped with a proton-conducting membrane, b) anodically oxidizing the HCl to generate chlorine radicals and hydrogen protons, c) reacting the chlorine radicals generated in step b) directly with the CO gas to produce phosgene, d) allowing the protons generated in step b) to migrate through the proton-conducting membrane to a cathode, and e) reducing the protons present at the cathode.

2. The process of claim 1 in which the protons are reduced in step e) to form hydrogen.

3. The process of claim 1 in which the protons are reduced in the presence of oxygen to form water in step e).

4. The process of claim 1 in which the chlorine radicals generated in b) are oxidized at the anode with CO gas to produce phosgene in accordance with the following reaction equations:

$$HCl+CO \xrightarrow{electrical\ energy} COCl^{\ominus}+e^{-}+H^{+}$$
$$COCl^{\ominus}+HCl \xrightarrow{electrical\ energy} COCl_2+e^{-}+H^{+}$$

5. The process of claim 4 which further comprises catalytically reacting molecular chlorine with carbon monoxide gas in carbon-containing support material of the activated diffusion anode.

6. The process of claim 5 in which the reaction of the chlorine radicals with CO or $COCl^{-}$ reduces the anodic overvoltage by from about 200 to about 600 mV.

7. The process of claim 6 in which oxygen is reduced at the cathode and reacts with the protons diffusing through the conducting membrane to produce water and reduce the operating voltage of the electrochemical cell.

8. The process of claim 7 in which the cathode is operated in aqueous hydrochloric acid to produce hydrogen as a secondary product.

9. The process of claim 8 in which moist oxygen is supplied to the cathode to moisten and thereby adjust the conductivity of the conducting membrane.

10. The process of claim 9 in which the electrochemical reactions that occur at the anode and cathode are conducted at a pressure of from about 2 to about 10 bar.

11. The process of claim 10 in which the phosgene drawn from the anode side of the electrochemical cell is cooled under pressure, liquefied, depressurized and vaporized.

12. The process of claim 11 in which the electrochemical cell is operated in a closed system at a pressure of from about 2 to about 6 bar and in a manner such that a slight pressure differential exists between the electrochemical cell and any apparatus into which phosgene is drawn.

13. The process of claim 1 which further comprises catalytically reacting molecular chlorine with carbon monoxide gas in a carbon-containing support material of the activated diffusion anode.

14. The process of claim 1 in which the reaction of the chlorine radicals with CO or $COCl^{-}$ reduces the anodic overvoltage by from about 200 to about 600 mV.

15. The process of claim 1 in which oxygen is reduced at the cathode and reacts with the protons diffusing through the conducting membrane to produce water and reduce the operating voltage of the electrochemical cell.

16. The process of claim 1 in which the cathode is operated in aqueous hydrochloric acid to produce hydrogen as a secondary product.

17. The process of claim 1 in which moist oxygen is supplied to the cathode to moisten and thereby adjust the conductivity of the conducting membrane.

18. The process of claim 1 in which the electrochemical reactions that occur at the anode and cathode are conducted at a pressure of from about 2 to about 10 bar.

19. The process of claim 1 in which the phosgene drawn from the anode side of the electrochemical cell is cooled under pressure, liquefied, depressurized and vaporized.

20. The process of claim 19 in which the electrochemical cell is operated in a closed system at a pressure of from about 2 to about 6 bar and in a manner such that a slight pressure differential exists between the electrochemical cell and any apparatus into which phosgene is drawn.

* * * * *